United States Patent [19]

Pawlak

[11] Patent Number: 4,745,386

[45] Date of Patent: May 17, 1988

[54] SOLENOID DEVICE

[75] Inventor: Stephen M. Pawlak, Homer, N.Y.

[73] Assignee: Smith Corona Corporation, Cortland, N.Y.

[21] Appl. No.: 879,736

[22] Filed: Jun. 27, 1986

[51] Int. Cl.[4] ..... H01F 7/08

[52] U.S. Cl. ..... 335/258; 335/261; 400/212

[58] Field of Search ..... 400/119, 121, 144.2, 400/157.2, 174, 175, 213.1, 215, 216, 216.1, 216.2, 212; 101/93.03; 335/251, 261, 278, 258

[56] References Cited

U.S. PATENT DOCUMENTS

| | | | |
|---|---|---|---|
| 4,308,794 | 1/1982 | Adamoli et al. | 101/93.03 |
| 4,331,010 | 5/1982 | Mitter | 400/121 X |
| 4,395,148 | 7/1983 | Gruner et al. | 400/216.1 X |
| 4,505,604 | 3/1985 | Takemoto | 400/157.2 X |
| 4,529,326 | 7/1985 | Mattsson | 400/157.2 |
| 4,557,193 | 12/1985 | Mattsson | 400/157.2 X |
| 4,600,322 | 7/1986 | Vermet-Gaud et al. | 400/121 X |
| 4,619,536 | 10/1986 | Takemoto | 400/144.2 X |

FOREIGN PATENT DOCUMENTS

| | | | |
|---|---|---|---|
| 156767 | 10/1985 | European Pat. Off. | 400/121 |
| 2219312 | 10/1973 | Fed. Rep. of Germany | 400/216 |
| 7371 | 1/1983 | Japan | 400/121 |
| 42420 | 3/1983 | Japan | 400/121 |

OTHER PUBLICATIONS

IBM Tech. Disc. Bulletin, "Performance Stabilization of Magnetic Actuator", Mitts et al., vol. 15, No. 8, Jan. 1973, p. 2356.

IBM Tech. Disc. Bulletin, "Impression Control for a Typewriter", Simpson, vol. 24, No. 12, May 1982, pp. 6528–6529.

*Primary Examiner*—Edgar S. Burr

*Assistant Examiner*—James R. McDaniel

*Attorney, Agent, or Firm*—Kenneth W. Greb

[57] ABSTRACT

An improved solenoid wherein the volume of a secondary air gap is increased during the plunger stroke, in order to reduce the increased plunger force that would otherwise occur during the plunger stroke.

1 Claim, 2 Drawing Sheets

SOLENOID DEVICE

STATEMENT AS TO RIGHTS TO INVENTIONS MADE UNDER FEDERALLY SPONSORED RESEARCH AND DEVELOPMENT

The invention disclosed and claimed herein was not made under any federally sponsored research and development program.

BACKGROUND OF THE INVENTION (1) Field of the Invention

This invention is concerned with an improved solenoid such as, but not limited to, solenoids which are used with ribbon lift devices of the type used in typewriters and printers. The invention also has application to other devices and apparatus which may utilize a solenoid of the plunger type wherein it is desired to reduce the increased plunger force that would otherwise occur during the plunger stroke.

(2) Description of the Prior Art

It is known in the prior art to provide means in a plunger-type solenoid to modify the plunger force characteristics that would otherwise occur during the plunger stroke. In such prior art devices, the force characteristics of the solenoid plunger stroke are modified to meet the particular requirements of the device or apparatus with which the solenoid is used.

One such example is the solenoid disclosed in U.S. Pat. No. 4,429,342 issued to U. Heider on Jan. 31, 1984 for an "Impact Printing Device with an Improved Print Hammer." This patent discloses a solenoid that is adapted to increase the speed of the print hammer operation in a printing mechanism and, as such, in contrast to the present invention, means are provided to increase the plunger force (and speed) during the solenoid plunger stroke.

SUMMARY OF THE INVENTION

The present invention is concerned with providing means to reduce the increased force of a solenoid plunger that would otherwise occur during the plunger stroke while maintaining the plunger force that occurs at the beginning of the plunger stroke. To achieve this, the present invention provides means by which the magnetic reluctance of a secondary air gap in the solenoid is increased during the plunger stroke operation.

The invention has particular utility in correction ribbon lift devices of the type used in typewriters and printers wherein it has been found that reducing the plunger force that would otherwise occur at the termination of the plunger stroke reduces the level of noise that is produced by the coaction of the plunger and the ribbon lift mechanism during a ribbon lift operation. In prior art devices of this type it was found that the plunger force increased rapidly during the plunger stroke (as a result of a decrease in the magnetic reluctance of a primary air gap in the solenoid), thereby greatly increasing the velocity, and therefore kinetic energy, of the plunger and ribbon lift mechanism. The noise level of the impact by which the plunger and mechanism are brought to a halt is generally undesirably high.

BRIEF DESCRIPTION OF THE DRAWING

A further understanding of the present invention may be had when the following detailed description is read in conjunction with the accompanying drawings in which.

DETAILED DESCRIPTION OF THE PREFERRED EMBODIMENT

Figure 1:
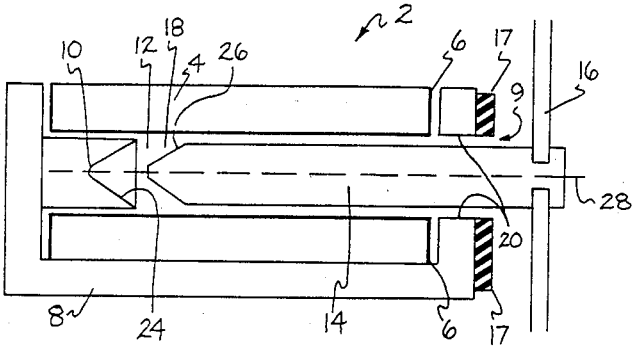
FIG. 1 is a side elevational view of a prior art solenoid of the same type as the present invention wherein the solenoid plunger is at its rest position.

In FIG. 1, there is shown a prior art solenoid 2 of the same type as the present invention and wherein the solenoid 2 is at its rest position. Such a prior art solenoid is used in a typewriter sold by the SCM Corporation under the model designation "XE 5000" and, in particular, it is used in conjunction with the correction ribbon device included in that typewriter. The solenoid 2 includes an excitation coil 4 of insulated wire which upon energization produces a magnetic field within the coil 4. An insulated spool 6 serves as a support for the coil 4.

The solenoid 2 further includes a stationary casing 8 of high magnetic permeability having a concentrator or extension 10 rigidly assembled at one end thereof. The stationary casing 8 has an opening shown generally as 9 therein which extends into a central recess 12. A plunger 14 of high magnetic permeability connected to a ribbon lift mechanism member 16 is located in the central recess 12 and is moveable therein. More specifically, energization of excitation coil 4 produces a magnetic field which causes the plunger 14 and the connected ribbon lift mechanism member 16 to move leftwardly until it reaches its final position abutting against a rubber abutment 17, shown in FIG. 2. As the ribbon lift mechanism member 16 moves to the left, conventional ribbon lift mechanism (not shown, but of the type included in the aforementioned SCM "XE 5000" typewriter) lifts the correction ribbon into its error correction position.

The force with which the plunger 14 moves through the central recess 12 is a function of the strength of the magnetic field that is induced in the recess. And the strength of the magnetic field is, in turn, a function of the amount of current, the number of turns of wire in the excitation coil 4 and the reluctance (i.e. the opposition presented to magnetic flux) of the magnetic circuit. The most significant components of the total solenoid reluctance are a primary air gap 18 and a secondary air gap 20.

More specifically, when the volume of the primary air gap 18 is decreased and the volume of the secondary air gap 20 remains the same, as when the plunger 14 moves to the left, the reluctance is decreased causing an increase in the magnetic flux. The magnetic flux increase causes an increase in the magnetic force on the plunger 14 and a corresponding increase in plunger and mechanism velocity. While it is desirable to have the plunger force at the beginning of the plunger stroke remain high, it has been found that the increased force of the plunger 14 that occurs during the plunger stroke abutting against the rubber abutment 17 with the ribbon lift mechanism produces a certain amount of undesirable noise.

The present invention is therefore concerned with maintaining the beginning plunger force, while reducing the amount of the increased plunger force that would otherwise occur during the plunger stroke. In that manner, the undesirable noise which is produced by the force of the plunger 14 with the ribbon lift mechanism 16 abutting against the rubber abutment 17 is reduced. That is achieved by increasing the reluctance of the magnetic circuit as shown in FIG. 3 and FIG. 4, and described hereinafter.

Figure 2:
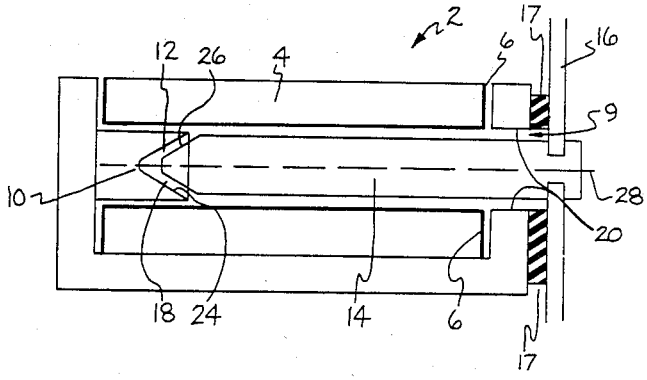
FIG. 2 is a side elevational view of the prior art solenoid illustrated in FIG. 1 wherein the solenoid plunger is at the completion of its stroke.
Figure 3:
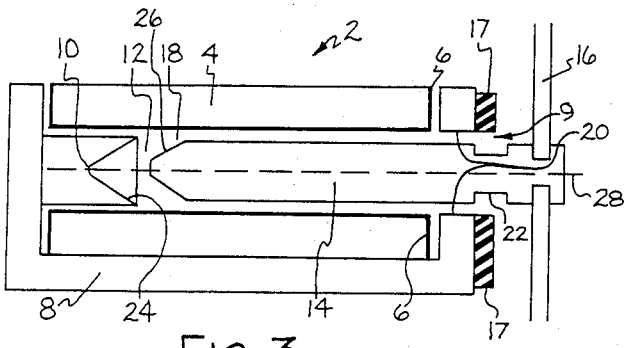
FIG. 3 is a side elevational view of the solenoid of the present invention wherein the solenoid plunger is at its rest position.
Figure 4:
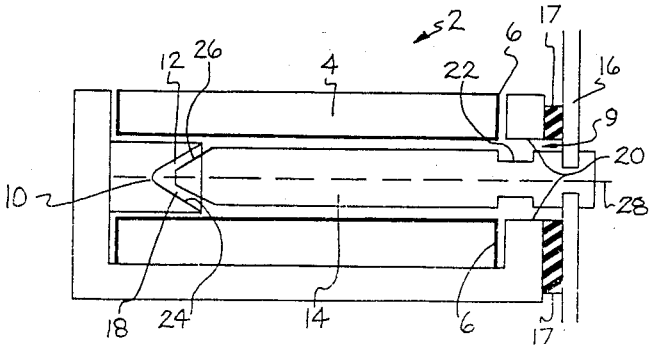
FIG. 4 is a side elevational view of the solenoid of the present invention wherein the solenoid plunger is at the completion of its stroke.

The solenoid mechanism shown in FIG. 3 and FIG. 4, comprises the same elements as the previously described prior art solenoid mechanism with the exception of the configuration of the plunger 14. Therefore, for convenience purposes, the same reference numerals are used to describe the elements of the present invention illustrated in FIGS. 3 and 4, as were used to describe the elements of the prior art illustrated in FIGS. 1 and 2. In addition, the foregoing description of those prior art elements shown in FIGS. 1 and 2 are incorporated herein by reference to describe the elements of the present invention shown in FIGS. 3 and 4.

In order to reduce the amount of increased plunger force that would otherwise occur during the plunger stroke, means are provided to increase the reluctance of one component of the magnetic circuit during the plunger stroke. This is achieved by increasing the volume of the secondary air gap 20 during the plunger stroke. More specifically, an annular groove 22 is provided at the rear of the plunger 14 which increases the volume of the secondary air gap 20 during the plunger stroke. In this manner, the reluctance of the secondary air gap 20 is increased during the plunger stroke; the amount of increased plunger force that would otherwise occur during the plunger stroke is reduced; and the noise produced by the coaction of the plunger 14 force with the ribbon lift mechanism 16 abutting against the rubber abutment 17 is likewise reduced. Sound measurements revealed the noise reduction to be greater than 3 dBA, which is significantly noticeable by the human ear.

A further reduction in the amount of increased plunger force during the plunger stroke is provided by a coaction of a cone shaped recess 24 in the concentrator 10 and a substantially mating cone shaped end 26 of the plunger 14. A direction of the magnetic forces caused by the cone shaped recess 24 and the cone shaped end 26 is angled relative to an axis 28 of the plunger 14 rather than being parallel to the axis 28. The angled magnetic forces reduces the amount of increased plunger forces during the plunger stroke.

It should be noted that the utility of the present invention is not limited to the use of the improved solenoid in reducing undesirable noise levels, but rather the improved solenoid is useful in any device in which it is desired to limit the increased plunger force that would otherwise occur during the plunger stroke.

Figure 5:
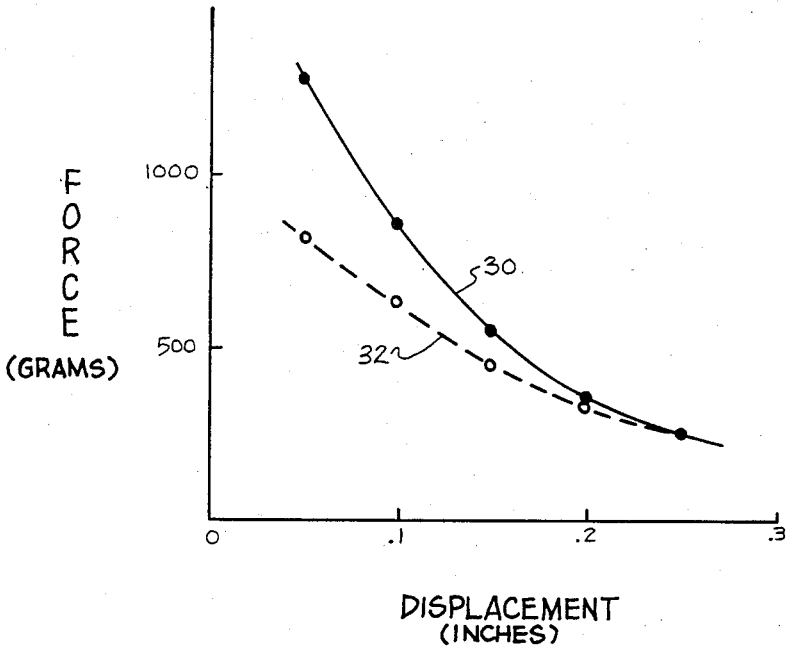
FIG. 5 is a graph showing plunger displacement versus plunger force for both the prior art solenoid and the solenoid of the present invention.

The effectiveness of the present invention in limiting the amount of increased plunger force that would otherwise occur during the plunger stroke is apparent from the graphic illustration of FIG. 5. That graph shows the test results of the plunger displacement versus plunger force for the prior art device, illustrated by the solid line 30, and the present invention, illustrated by the dotted line 32. This data was obtained under constant and equal amphere-turns applied to both solenoids.

Variations and modifications including, but not limited to, those discussed above will occur to those skilled in the art once they are made aware of the basic concepts of the invention. Therefore, it is intended that the appended claims shall be construed to include not only the embodiments expressly described above, but all other variations and modifications as fall within the true spirit and scope of the invention.

Having thus described my invention, what I claim as novel and desire to secure by Letters Patent is:

1. A plunger-type solenoid device for reducing an amount of increased plunger force that would otherwise occur during a plunger stroke comprising:

a. a stationary casing consisting of material of high magnetic permeability and having an opening from which a central recess extends;

b. a plunger consisting of material of high magnetic permeability disposed in the central recess for movement therein;

c. an excitation coil wound around the plunger which generates a magnetic field within the central recess for moving the plunger in the central recess;

d. a primary air gap formed between the plunger and an inner wall of the stationary casing;

e. a secondary air gap formed between the plunger and the opening in the casing; and f. the plunger having an annular groove, the annular groove being located outside of the primary air gap and the secondary air gap before movement of the plunger in the central recess to maintain a high plunger force at the beginning of the plunger stroke, and the annular groove moves within the secondary air gap for reducing the amount of increased plunger force during the plunger stroke.

* * * * *